US006754999B1

(12) United States Patent
Urbanczyk

(10) Patent No.: US 6,754,999 B1
(45) Date of Patent: Jun. 29, 2004

(54) BUILDING CONSTRUCTION SYSTEM

(76) Inventor: Delmer L. Urbanczyk, Box 835, Ft. Leonard Wood, MO (US) 65473

( * ) Notice: Subject to any disclaimer, the term of this patent is extended or adjusted under 35 U.S.C. 154(b) by 0 days.

(21) Appl. No.: 09/849,546

(22) Filed: May 4, 2001

(51) Int. Cl.[7] ..... E04B 2/58; E04B 1/08

(52) U.S. Cl. ..... 52/272; 52/656.9; 52/656.1; 52/653.1; 52/636; 52/271

(58) Field of Search ..... 52/270, 271, 261, 52/283, 285.1, 262, 236.7, 636, 272, 653.1, 656.1, 656.2, 656.9, 16, 90.2, 91.1, 93.1, 92.2, 481.1, 236.9, 647, 91.3, 731.9, 733.2, 93.2

(56) References Cited

U.S. PATENT DOCUMENTS

| | | | | | |
|---|---|---|---|---|---|
| 1,322,189 | A | * | 11/1919 | Holt | 52/16 |
| 1,818,418 | A | * | 8/1931 | Millard | 52/92.2 |
| 1,850,118 | A | * | 3/1932 | Meyers | 52/93.1 |
| 1,893,636 | A | * | 1/1933 | Ridgway | 52/93.1 |
| 1,910,264 | A | * | 5/1933 | Shanley et al. | 52/79.1 |
| 1,988,388 | A | * | 1/1935 | Moition | 52/93.1 |
| 2,104,500 | A | * | 1/1938 | Buren | 52/236.9 |
| 2,131,466 | A | * | 3/1938 | Levey | 52/92.2 |
| 2,541,784 | A | * | 2/1951 | Shannon | 52/92.1 |
| 2,590,123 | A | * | 3/1952 | Rapp | 52/92.2 |
| 2,934,934 | A | | 3/1960 | Berliner | 72/40 |
| 3,205,632 | A | | 9/1965 | McCormick | 52/588 |
| 3,330,084 | A | * | 7/1967 | Russell | 52/92.1 |
| 3,579,943 | A | * | 5/1971 | Wayne | 52/270.1 |
| 3,657,849 | A | * | 4/1972 | Garton | 52/90 |
| 3,668,828 | A | * | 6/1972 | Nicholas et al. | 52/92 |
| 4,045,937 | A | | 9/1977 | Stucky | 52/745 |
| 4,143,498 | A | | 3/1979 | Martin, Jr. et al. | 52/489 |
| 4,261,143 | A | * | 4/1981 | Rizzo | 52/16 |
| 4,342,177 | A | * | 8/1982 | Smith | 52/93 |
| 4,435,940 | A | * | 3/1984 | Davenport et al. | 52/641 |
| 4,554,124 | A | | 11/1985 | Sudrabin | 264/263 |
| 4,986,052 | A | * | 1/1991 | Nelson | 52/745 |
| 5,152,114 | A | * | 10/1992 | Beazley et al. | 52/264 |
| 5,649,403 | A | * | 7/1997 | Haisch | 52/693 |
| 5,689,922 | A | * | 11/1997 | Daudet | 52/210 |
| 5,797,233 | A | * | 8/1998 | Hascall | 52/481.1 |
| 6,061,995 | A | | 5/2000 | Menchetti et al. | 52/794.1 |
| 6,085,485 | A | | 7/2000 | Murdock | 52/783.19 |
| 6,092,340 | A | * | 7/2000 | Simmons | 52/92.1 |
| 6,430,881 | B1 | * | 8/2002 | Daudet et al. | 52/92.2 |

FOREIGN PATENT DOCUMENTS

| | | | | |
|---|---|---|---|---|
| GB | 2049781 | * | 12/1980 | 52/653.1 |

* cited by examiner

*Primary Examiner*—Phi Dieu Tran A
(74) *Attorney, Agent, or Firm*—Grace J. Fishel

(57) ABSTRACT

A structural system with a plurality of metal framed load bearing walls formed in one or more sections with a support post connected in line to the ends of each load bearing wall. A plurality of metal framed roof trusses in one or more sections parallel with and connected to the top of the load bearing walls. A metal framed roof formed in one or more sections and spanning adjacent roof trusses. Each wall, truss and roof section formed with metal tracks and C-shaped studs.

10 Claims, 12 Drawing Sheets

24
12

14 (14e)
24
64
28
28
26
26
16
48

18
72
68

88
70
74
76
24
28
86
28
12
14 (14e)
26
26
16
48
64
62

BUILDING CONSTRUCTION SYSTEM

BACKGROUND OF THE INVENTION

1. Field of the Invention

The present invention relates to an improved structural system including metal framed wall sections, posts, truss sections and roof sections.

2. Brief Description of the Prior Art

For centuries, home builders in the United States have made wood their material of choice because of its satisfactory performance, abundant supply and relatively low cost. However, recent increases and unpredictable fluctuations in the price of framing lumber, as well as concerns with its quality, are causing builders and other providers of affordable housing to seek alternative building products.

Use of steel framing in the residential market has increased over the past several years. Its price stability, consistent quality, similarity to conventional framing, and resistance to fire, rot and termites have attracted the attention of many builders and designers.

The price of steel is stable. Mills can guarantee prices two or three years in advance, whereas lumber yards cannot guarantee a price 30 days out. Uniformity is another advantage over lumber. When the lumber a contractor has ordered arrives, the contractor must be selective about which pieces he will use because not all of the lumber is uniform.

Steel framing can be used to build wall sections and trusses like conventional framing. Steel framed wall sections are typically formed from an upper and lower track with a plurality of spaced apart C-shaped studs arranged at predetermined intervals between the top and bottom tracks. Construction details of the intersection between load bearing and non-load bearing walls are like their wood frame counterparts. Roof trusses made of steel framing also resemble wood framing with rafters and ceiling joists formed of C-shaped studs. A ridge member constructed of a C-shaped stud inside a track section connects the rafters. In a conventional wood or steel framed house having peaked roof sections, the rafters are perpendicular to and rest on the load-bearing walls. The end walls and interior walls parallel to the rafters are typically non-load bearing. Conventional building design with wood or steel roof trusses does not lend itself to expansive vertical interior spaces as the roof trusses fill the area above the ceiling joists.

Steel does not rot, warp, split, crack or creep. Callbacks because of nailpops do not occur with steel framing. It does not expand or contract with moisture content. It does not burn and it will not contribute fuel to the spread of a fire. Termites cannot eat it and it does not provide a comfortable home for other undesirable organisms such as cockroaches.

One major drawback to steel construction, however, is the lack and higher cost of skilled labor at a job site. Screws or welds in assembling the wall sections and roof trusses take longer with steel framing than fastening wood.

BRIEF SUMMARY OF THE INVENTION

In view of the above, it is an object of the present invention to provide a construction system using prefabricated sections which can be made on automated equipment. It is another object to provide a construction system using metal framing for making a building with expansive vertical interior spaces without special beams. It is also an object to provide a construction system using metal framing that is wind and earthquake resistant. Other objects and features of the invention will be in part apparent and in part pointed out hereinafter.

A structural system in accordance with the present invention includes the following features:

(1) A plurality of metal framed load bearing walls formed in one or more sections, each section having an upper and a lower track and a plurality of vertical C-shaped studs arranged at predetermined intervals between the upper and lower tracks. A support post is connected in line to the ends of each load bearing wall. The support post is formed of a pair of C-shaped studs having a web, with the pair arranged back-to-back along the webs forming an I-beam on a plate adapted to be attached to a foundation or a slab.

(2) A plurality of metal framed roof trusses are also provided. Each truss having one or more sections with an upper and lower chord formed by tracks and a plurality of vertical C-shaped studs arranged at predetermined intervals between the upper and lower tracks. The lower track of each roof truss and the top track of each wall section are connected back-to-back forming an I-beam.

(3) A metal framed roof formed of a plurality of roof sections. Each roof section having right and left tracks and a plurality of horizontal C-shaped studs arranged at predetermined intervals between the right and left tracks. The roof section is adapted to span adjacent roof trusses when connected to the upper tracks of the trusses.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
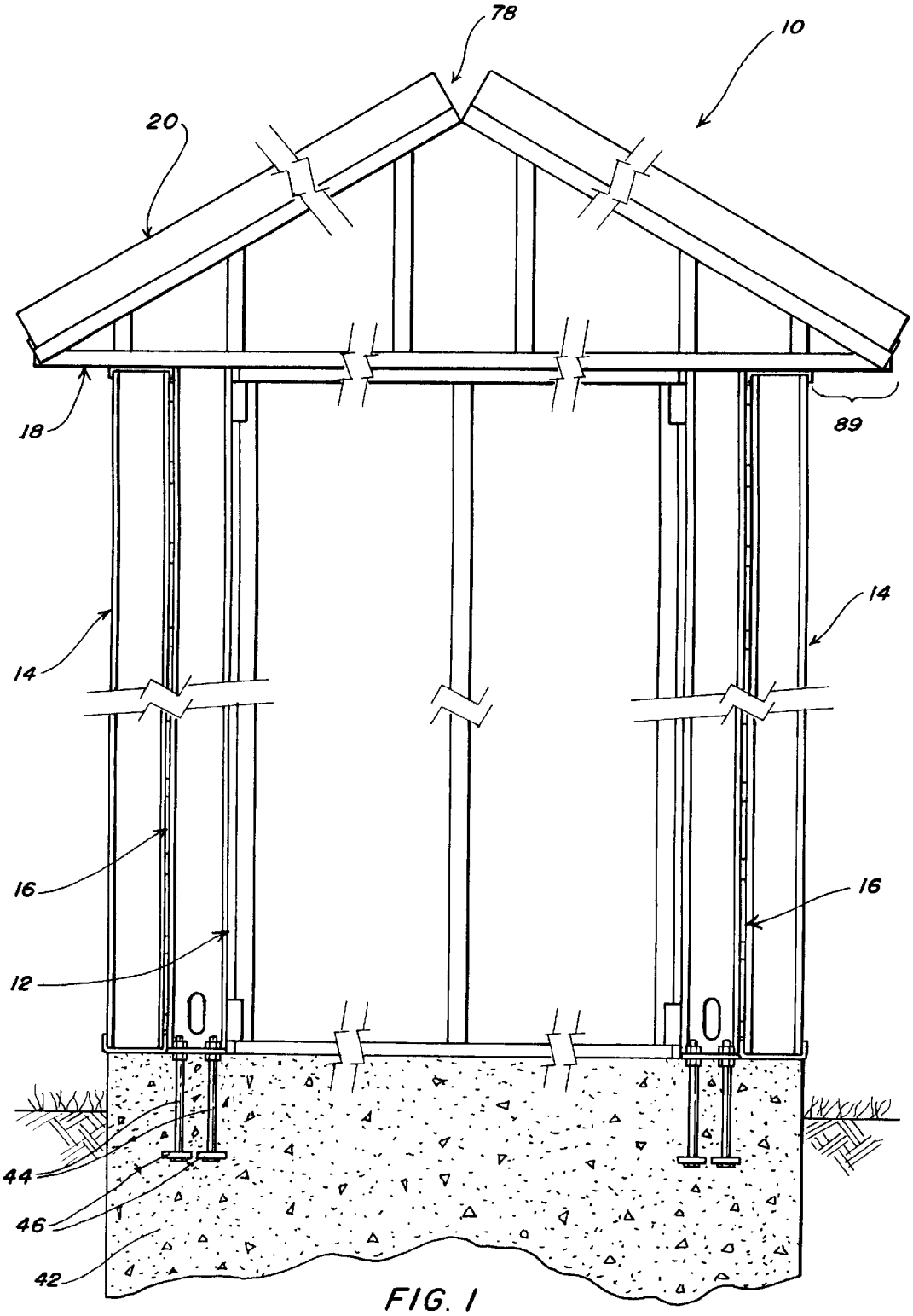
FIG. 1 is a end view of a structural system, partly in section, showing a load bearing wall, non-load bearing curtain walls, support posts, roof truss and roof frame.
Figure 13:
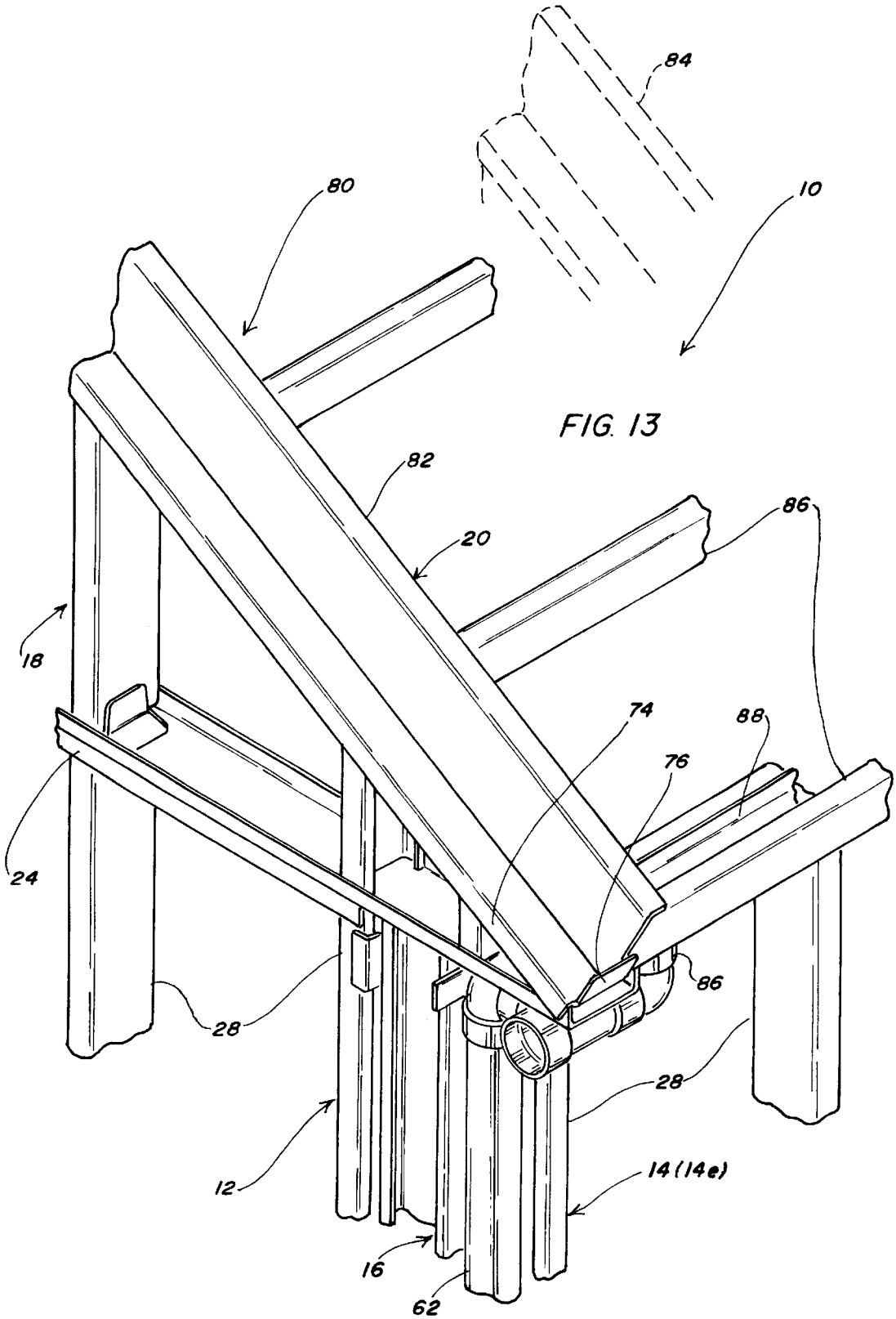
FIG. 13 is like FIG. 11 but additionally showing a roof frame.
Figure 14:
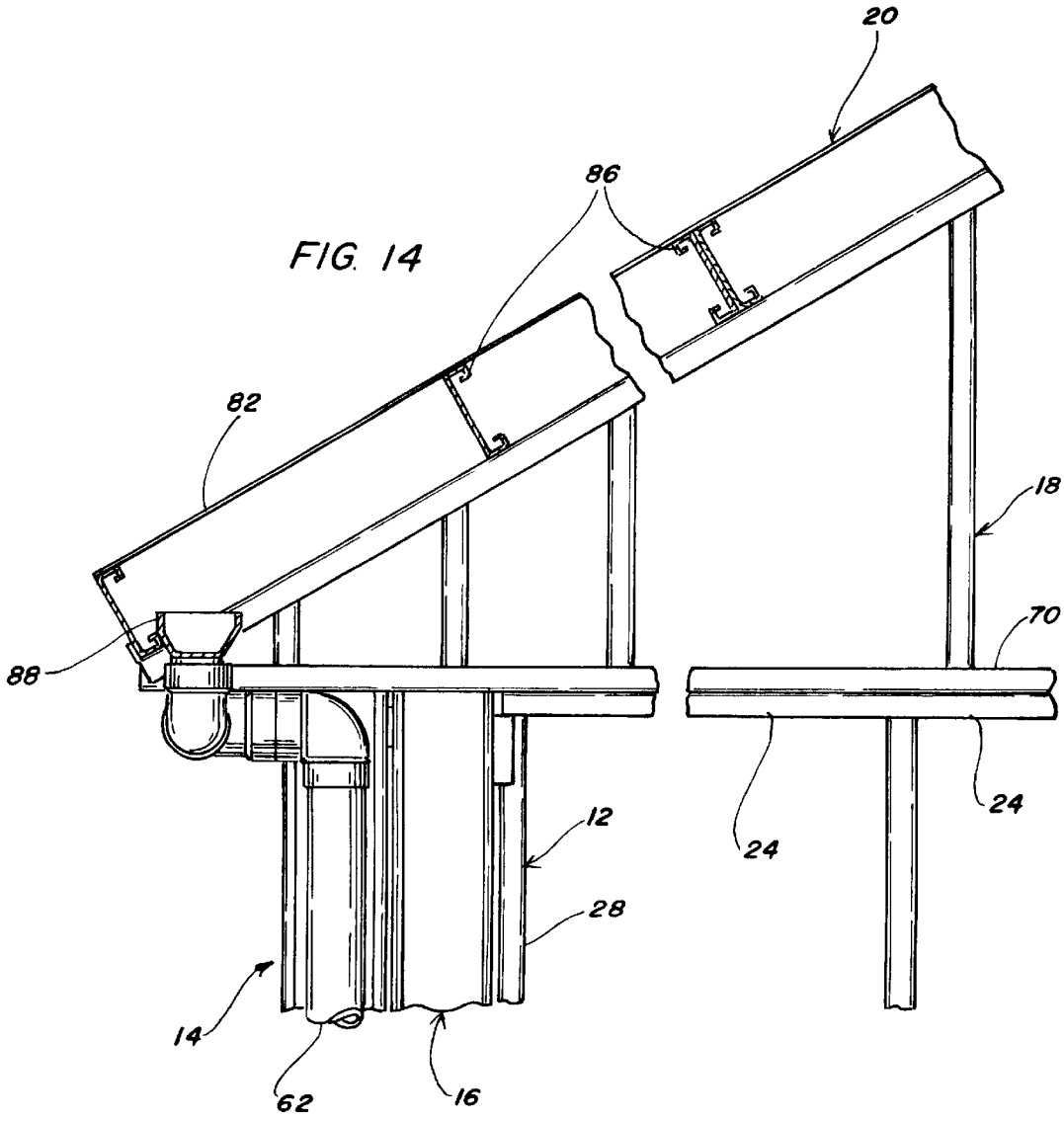
FIG. 14 is a side elevation of the structure shown in FIG. 13.

Referring to the drawings more particularly by reference character, reference numeral 10 identifies an improved structural system in accordance with the invention. As shown in FIGS. 1, 13 and 14, structural system 10 includes load bearing and non-load bearing walls 12, 14, respectively, support posts 16, roof trusses 18 and roof frame 20 more particularly described below.

Figure 3:
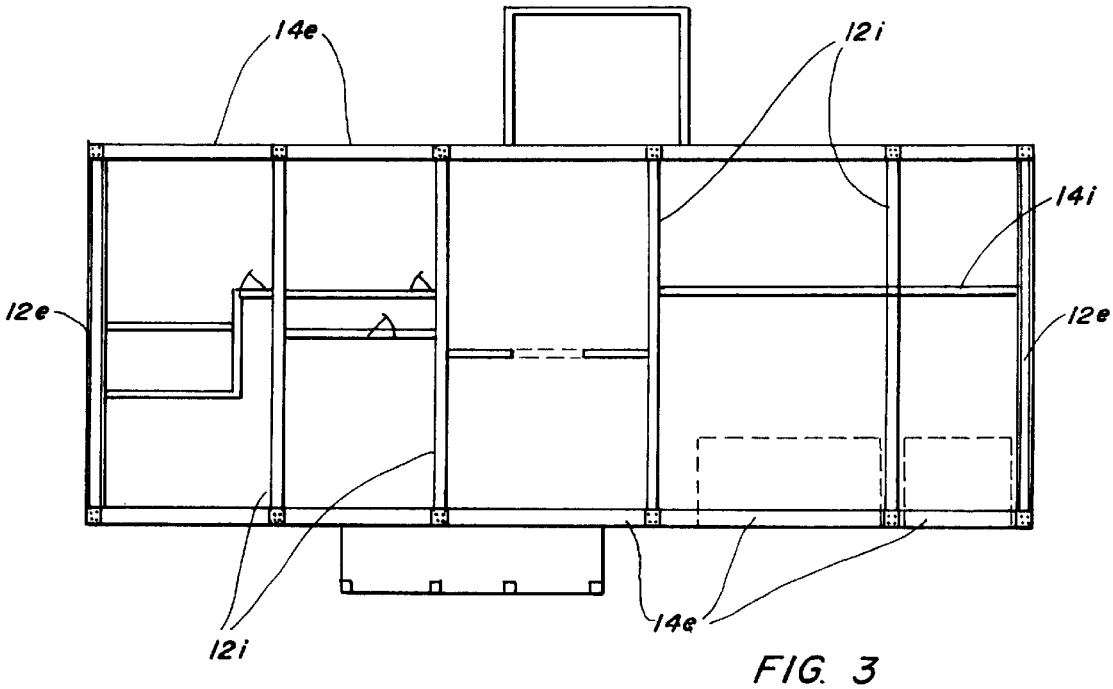
FIG. 3 is a floor plan of the same house showing load bearing interior and end walls and non-load bearing interior and curtain walls.

Load bearing and non-load bearing walls 12, 14 are identical except that non-load bearing walls 14 carry no part of the vertical load of the building, supporting just the axial load of the wall itself and the weight of any finishes. This affects the gauge of the material, as more particularly described below, from which walls 12, 14 are constructed. As shown in FIG. 3, load bearing interior walls 12*i* are parallel to end walls 12*e* which are also load bearing. Non-load bearing curtain walls 14*e* are perpendicular to load bearing walls 12. Curtain walls 14*e* are designed to withstand and transfer wind loads to the structure. Building length is along curtain walls 14*e* and building width is along end walls 12*e*, normally the shorter dimension of a rectangular building's footprint.

Figure 5:
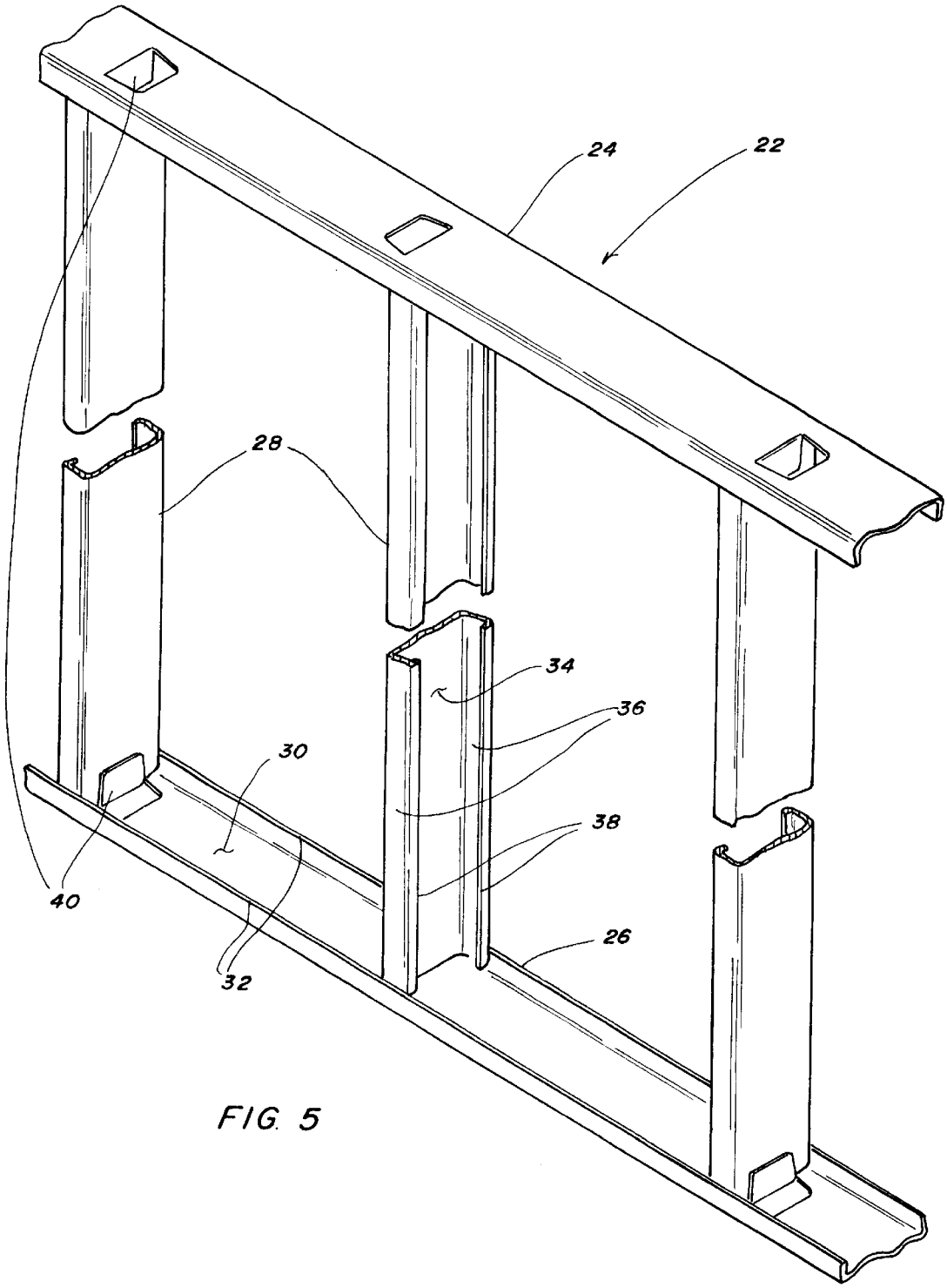
FIG. 5 a perspective view of a portion of a wall section.

Load bearing and non-load bearing walls 12, 14 are formed of one or more wall sections 22, a representative one of which is shown in FIG. 5. Each section 22 has upper and lower tracks 24, 26, respectively, and a plurality of vertical C-shaped studs 28 arranged at predetermined intervals between the upper and lower tracks 24, 26. Wall sections 22 are preferably 8 feet in length and 8 or 9 feet in height. Prefabricated wall sections 22 having these dimensions are preferred as they are readily transportable from a factory to a job site for use in constructing a building with 8 or 9 foot ceilings at the outer walls.

Each of tracks 24, 26 is U-shaped with a flat web 30 and a pair of flanges 32. Flanges 32 may be "toed in" to provide a friction grip on studs 28 during installation. Each of C-shaped studs 28 has a flat web 34 and a pair of flanges 36 with inwardly turned lips 38 for stiffening the flanges. Aligned flaps 40 may be formed in each of tracks 24, 26 and bent for connection to studs 28. C-shaped studs 28 are typically set on 16 or 24 inch centers and faced in the same direction, except where required at a wall opening and for the endmost studs 28 in each wall section 22 which may face inwardly of the section such that the studs in adjoining wall sections may be connected with their webs 34 back-to-back forming an I-beam. Aside from structural reasons, having all the studs faced in the same direction makes the installation of batt insulation easier.

Figure 4:
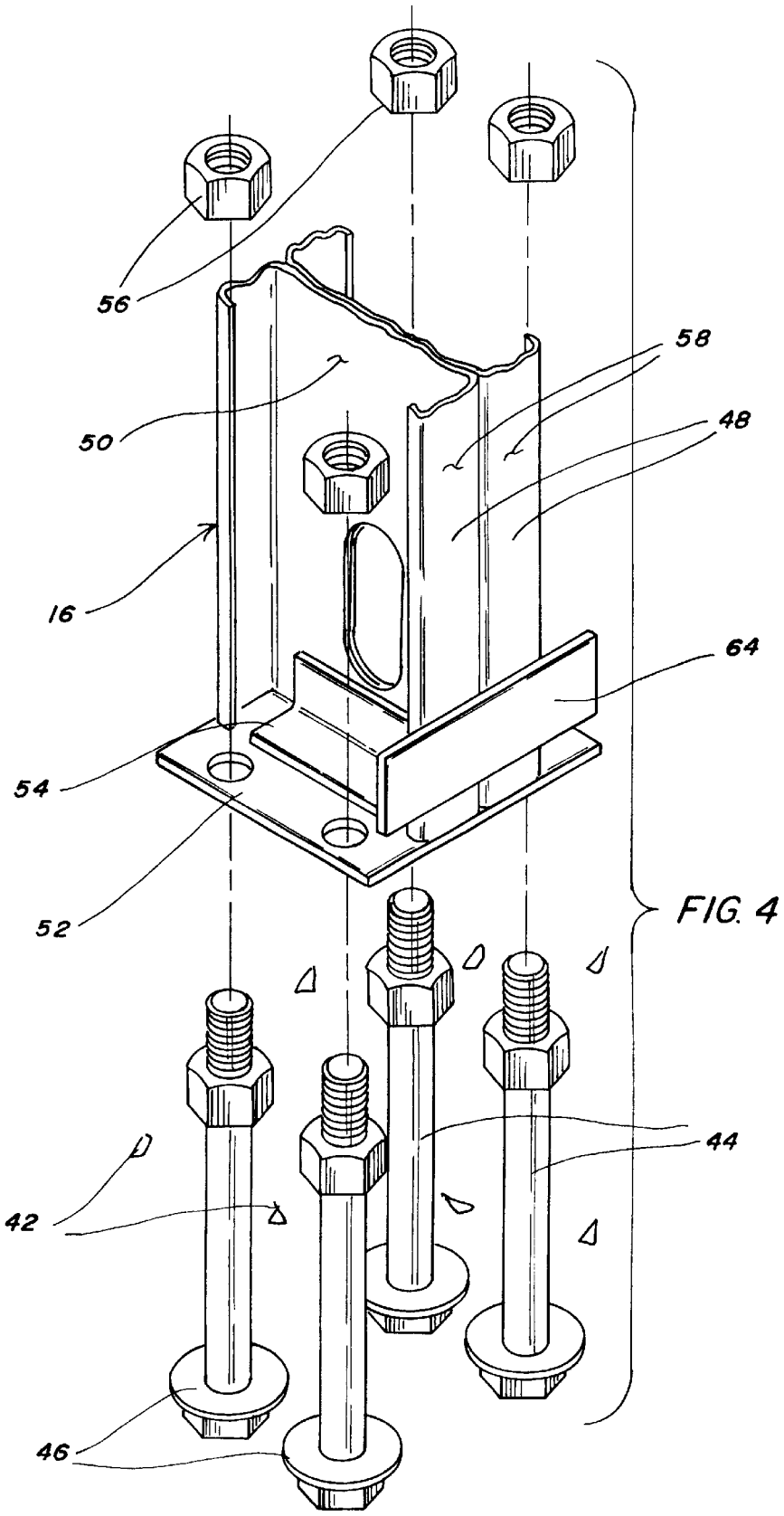
FIG. 4 is an exploded perspective view showing a connection of a support post to bets adapted to be embedded in a slab or foundation.
Figure 8:
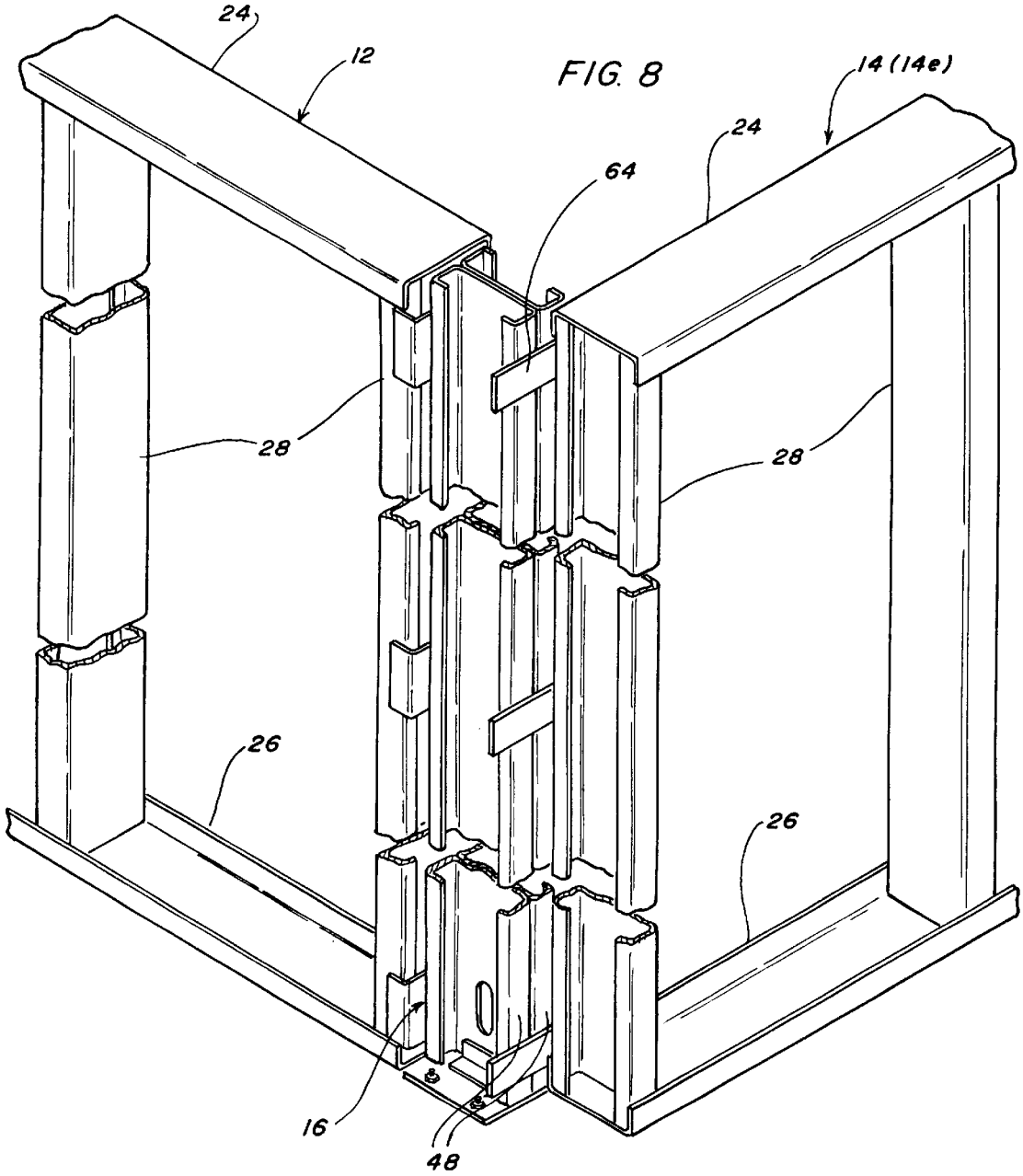
FIG. 8 is like FIG. 6 but additionally showing a non-loading bearing curtain wall connected to the support post.
Figure 10:
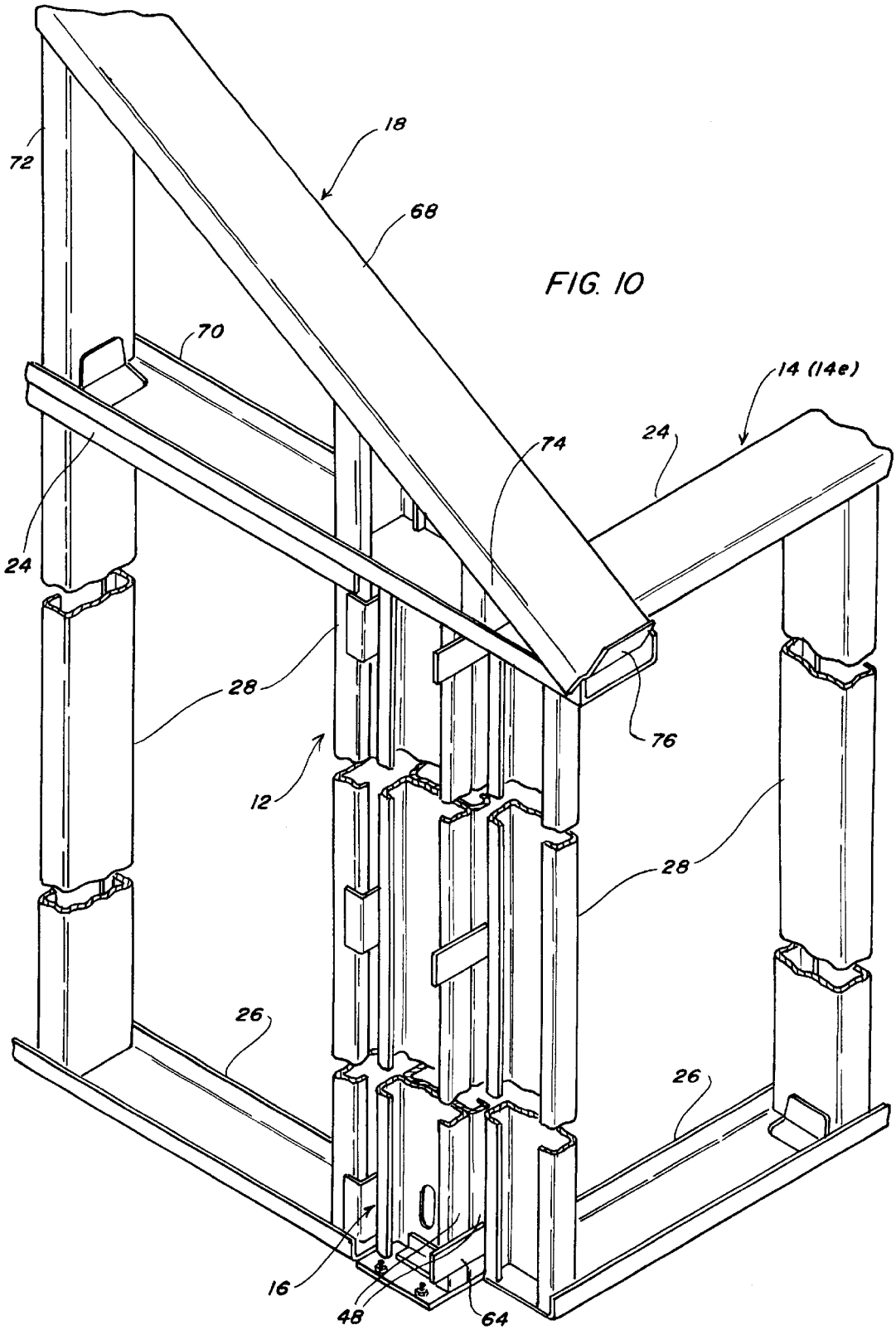
FIG. 10 is like FIG. 8 but additionally showing a roof truss connected to the load bearing wall.
Figure 11:
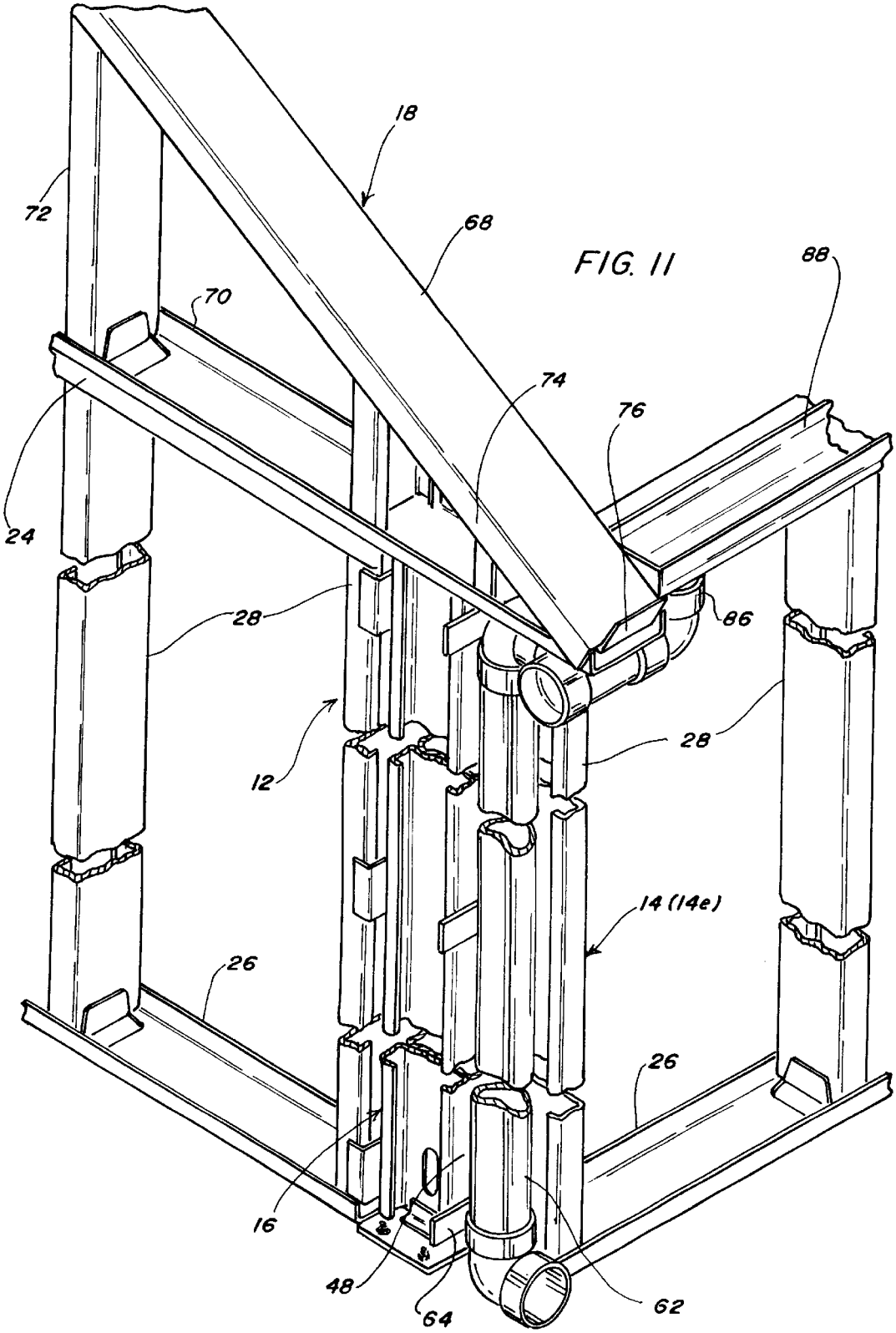
FIG. 11 is like FIG. 10 but additionally showing a drain gutter and a downspout.

One of support posts 16 is provided at the ends of each load bearing wall 12*i* and 12*e*. As shown in FIGS. 1 and 4, support posts 16 are anchored to a slab or a foundation 42 with bolts 44 and washers 46 on the embedded end. It will be understood, however, that support posts 16 may be connected to the slab or foundation 42 with drilled expansion anchors, epoxy anchor bolts, etc. With continuing reference to FIG. 4, support posts 16 are shown as including a pair of C-shaped studs 48 connected back-to-back along their webs 50 forming an I-beam. Studs 48 are connected to a plate 52 with a L-shaped bracket 54 and plate 52 is attached to threaded bolts 44 with nuts 56. It will be understood that flanges 58 of C-shaped studs 48 may be cut and web 50 bent to allow connection of support posts 16 to plate 52. A plurality of straps 64 (one of which is shown in FIG. 4 and a plurality of which are shown in FIGS. 6, 8, 10 and 11) are connected to studs 48 such that they extend beyond flanges 58 for use in connecting curtain walls 14*e* as best seen in FIGS. 8, 10 and 11 described below.

Figure 6:
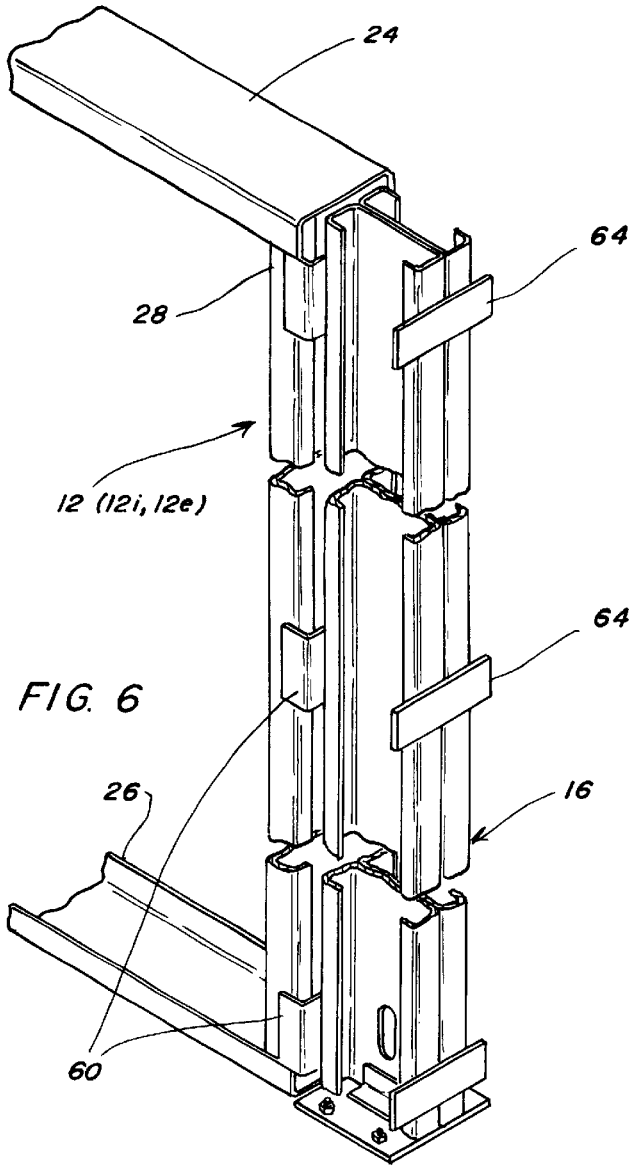
FIG. 6 is a perspective view of a load bearing wall connected to a support post.
Figure 7:
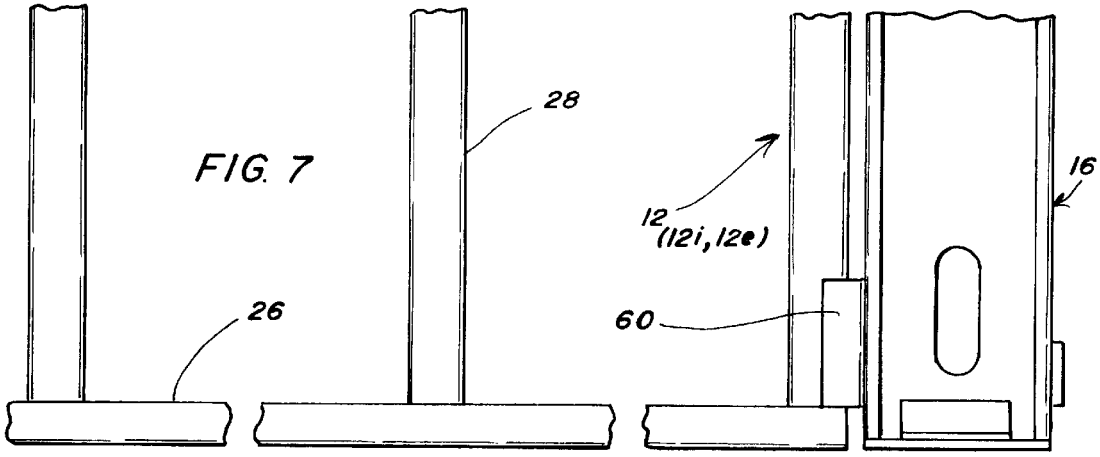
FIG. 7 is a side elevation, partly broken away, showing shims for attaching a load bearing wall to a support post.

As best seen in FIGS. 6 and 7, load bearing walls 12*i* and 12*e* are connected to support posts 16 by a plurality of spacedpart U-shaped channels 60 which may be short sections of track. U-shaped channels 60 serve as shims such that wall sections 22 may be prefabricated off-site, set into place and connected to support posts 16 which are installed on foundation 42 first. Curtain walls 14*e* are connected to the outside of support posts 16 as seen in FIGS. 8 and 10–14. For the purpose of accommodating a downspout 62, curtain walls 14*e* may be connected to straps 64 with a space left between the ends of the walls to accommodate downspout 62, otherwise straps 64 may be omitted and curtain walls 14*e* butted end-to-end and connected to flanges 58 of support posts 16. Support posts 16 have a height equal to the height of load bearing walls 12.

Figure 9:
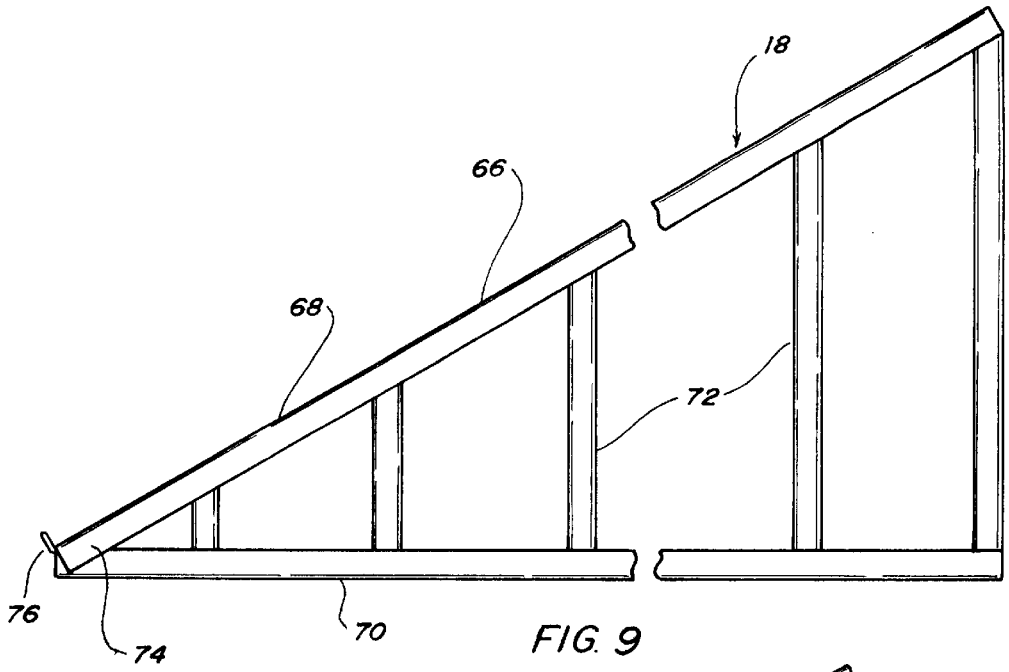
FIG. 9 is a side elevation of a truss section.
Figure 12:
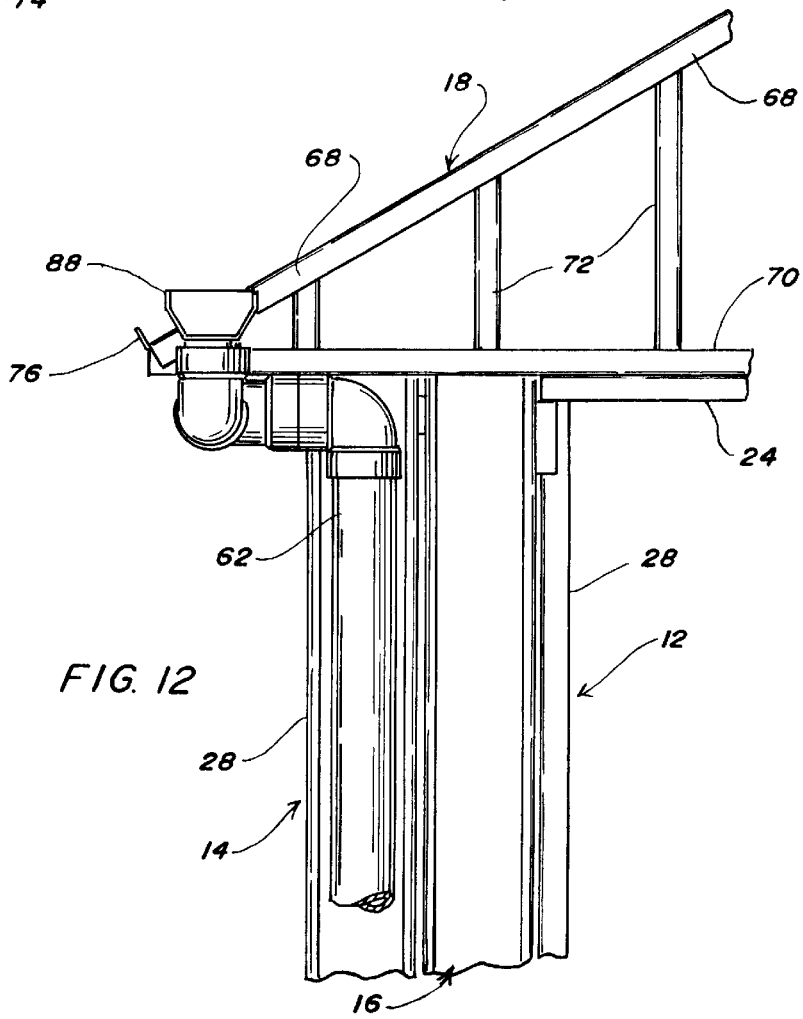
FIG. 12 is side elevation of the structure shown in FIG. 11.

Roof trusses 18 are formed of one or more truss sections 66, one of which is shown in FIG. 9. Each truss section 66 has a portion of the upper and lower chord formed by tracks 68, 70, respectively, and a plurality of vertical C-shaped studs 72 arranged at predetermined intervals between tracks 68, 70. Truss sections 66 are connected to load bearing walls 12 with lower track 70 of each truss section 66 and upper track 24 of each wall section 22 being connected back-to-back along their track webs forming an I-beam. As seen in FIGS. 9–13, flanges 74 are cut away and a portion of the web bent upwardly at the eaves to form a saddle 76 for roof frame 20 as shown in FIGS. 1, 13 and 14. It is preferred that truss sections 66, like wall sections 22, be 8 feet in length such that they can be transported from the factory. It is also preferred that one of truss sections 66 include studs 72 on both sides of roof ridge 78 as shown in FIG. 1 without a ridge member as in conventional metal framing. As in wall sections 22, studs 72 in truss sections 66 all faced in the same direction with the exception of the endmost studs which may face inward of the section such that adjacent sections may be joined with studs 72 back-to-back along their webs forming an I-beam. In a preferred embodiment studs 72 in truss sections 66 are vertically in-line with studs 28 in wall sections 22 to transfer loads to the member below and foundation 42.

Figure 15:
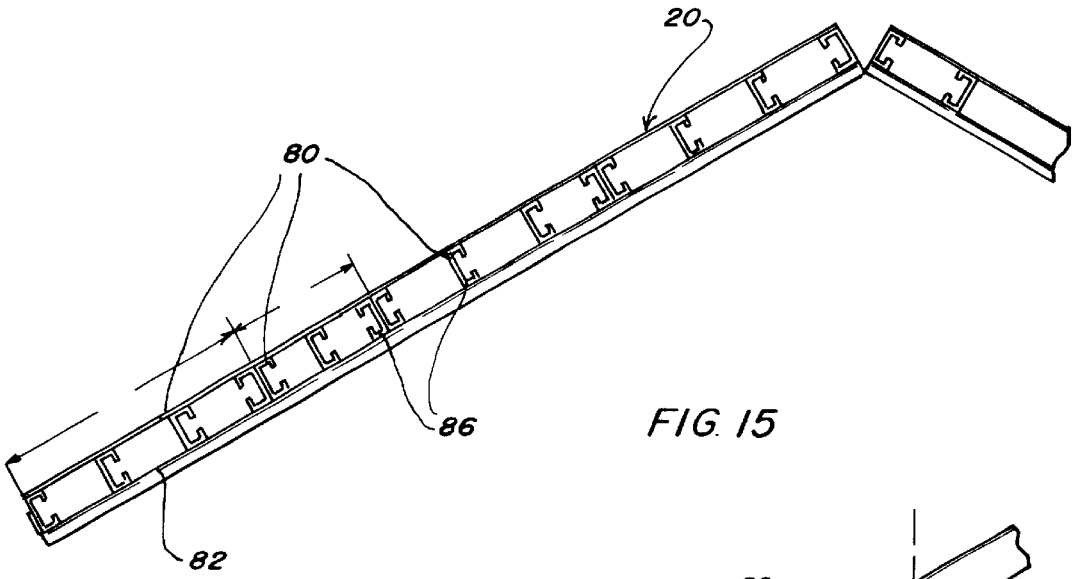
FIG. 15 is a side elevation of the roof frame showing 8 foot and 4 foot roof sections; and, FIG. 16 is view showing a suspended ceiling.

Roof frame 20 is formed of roof sections 80, each roof section having right and left tracks 82, 84 (FIG. 13), respectively, and a plurality of horizontal C-shaped studs 86 arranged at predetermined intervals between tracks 82, 84. Roof sections 80 are adapted to span adjacent roof trusses 18 when connected to upper tracks 68 of the trusses. In a preferred embodiment studs 86 in roof sections 80 are vertically in-line with studs 72 in truss sections 66 and wall sections 22 to transfer the load to the members below. It is also preferred that roof sections 80 be 8 feet wide and have a length equal to the distance between adjacent roof trusses 24 on center. If the length of the roof is greater than an whole number multiple of the width of roof sections 80, it is preferred that a narrow roof section as shown in FIG. 15 be sandwiched between the larger panels. As shown in FIG. 13, a gap may be provided in the roofing system applied to roof frame 20 such that water is directed into a drain trough 88 provided under a rake overhang 89 of the roof (see FIG. 1). Trough 88 drains into downspout 62 which can be embedded in curtain wall 14*e* as described above.

Figure 16:
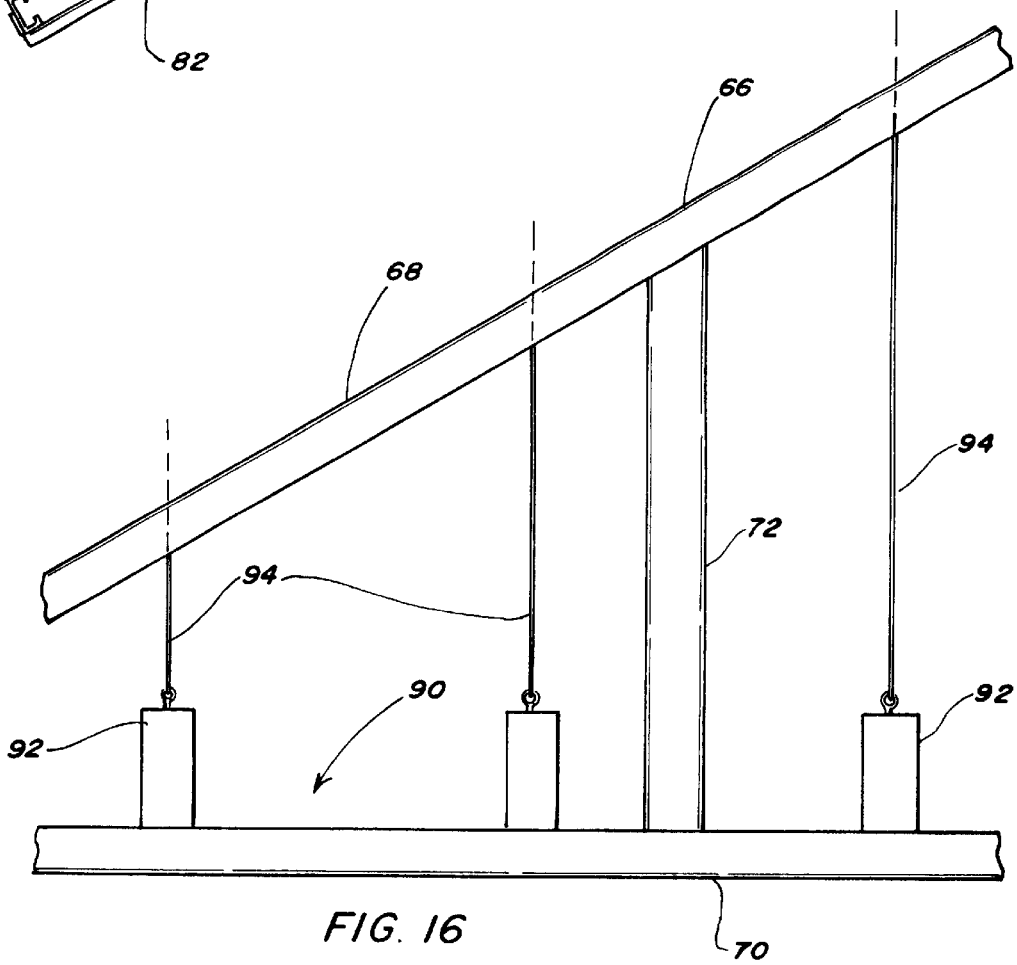

Structural system 10 provides expansive vertical interior spaces as the area under roof frame 20 between roof trusses 18 is open. If desired, a suspended ceiling 90 as shown in FIG. 16 may be provided, for example in bedrooms where a more enclosed feeling is wanted. Suspended ceiling 90 is formed with studs 92, preferably wood, which are supported at opposite ends on lower track 70 of adjacent truss sections 66. Between truss sections 66, studs 92 may be wired 94 to roof sections 80 (not shown in FIG. 16).

The various wall sections 22, truss sections 66, roof sections 80 and support posts 16 are preferably fabricated and connected together by welding; however, they may be connected with self tapping screws or the like. Wall sections 22 with window and door openings, truss sections 66, roof sections 80 and support posts 16 may be made on the job site but it is preferred that the components be prefabricated. This overcomes the problems with the lack and high cost of skilled labor at the job site in working with metal framing as the factory can be equipped with suitable automated equipment providing consistent quality. The finishes (e.g., plywood, wallboard, etc.) may also be applied to wall sections 22 and roof sections 80 at the factory. The prefabricated sections are then transported to the building site where they are preferably welded together.

For a single story house using structural system 10, the following materials may be used with in-line framing practices:

Load bearing walls 12: 18 gauge track and 18 gauge C-studs.

Non-load bearing walls 14: 22 gauge track and 22 gauge C-studs.

Roof trusses 18: 18 gauge track and 18 gauge C-studs.

Roof frame 20: 18 gauge track and 12–26 gauge C-studs (depending on the span between adjacent roof trusses).

Support posts: 18 gauge C-studs.

For some applications, lighter or heavier gauge material may be used. For example, for very long spans between adjacent roof trusses, it may be necessary to use heavier material in roof frame 20. On the other hand, shorter spans require less strength. The same reasoning applies to load and non-load bearing walls 12, 14 and to roof trusses 18, the size of the C-studs depending on the weight carried by the wall or truss. It should be appreciated that this gives construction system 10 a big advantage over wood framing in that the gauge of the studs may be changed instead of changing the spacing between the studs to adjust for the load. With wood framing, it may be necessary to change the spacing between the studs to compensate for the load or for bad lumber. With construction system 10, consistent spacing between the studs facilitates automation in manufacturing the various sections.

The C-studs and tracks may be provided with punchouts for the installation of plumbing, electrical and utilities. A punchout may be made during the manufacturing process or in the field with a hand punch, hole saw or other suitable tool.

Figure 2:
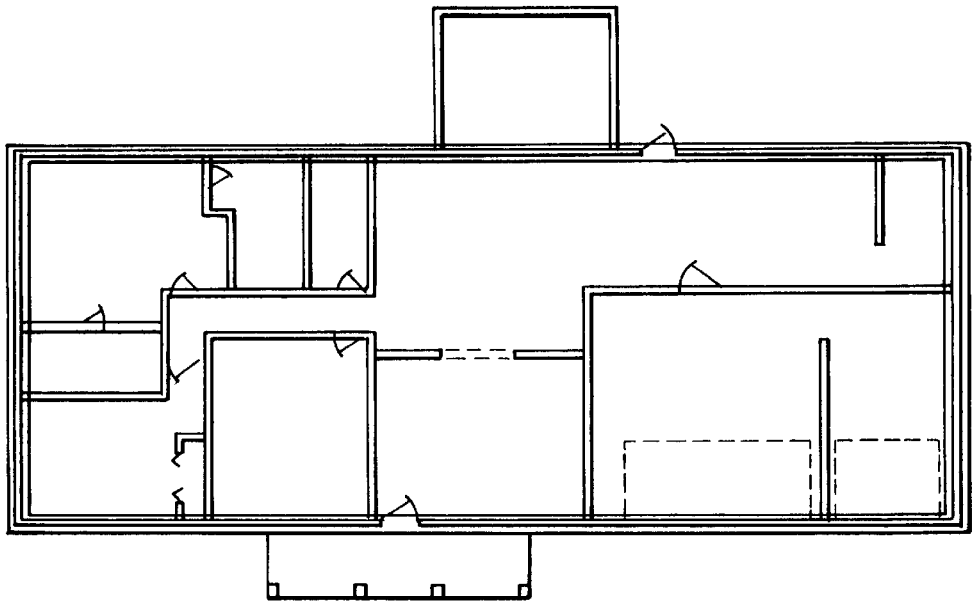
FIG. 2 is a floor plan of a house.

Structural system 10 can be used as follows: A floor plan of a house or other structure is developed as shown in FIG. 2 and the load bearing and non-load bearing walls planned as shown in FIG. 3. It is preferred that the load bearing walls not be more than 20 feet apart on center as this effects the length of roof sections 80.

A slab or foundation 42 is poured with bolts 44 for support posts 16 at the ends of each load bearing wall 12. Unlike a conventional frame house, a foundation is needed under load bearing walls 12 only as curtain walls 14*e* are suspended between support posts 16 and need not be underpinned with foundation 42 (see FIG. 1).

After the slab or foundation 42 is prepared, support posts 16 are installed on bolts 44. Load bearing walls 12*i* and 12*e* and non-load bearing curtain walls 14*e* are connected to support posts 16. Roof trusses 18 are connected to load bearing walls 12*i* and 12*e* and roof frame 20 connected to roof trusses 18. Where a finish has been applied to non-load bearing curtain walls 14*e* and roof sections 80 at the factory, the building is ready for windows and doors to be installed. The interior of the building may be finished with suspended ceilings and non-load bearing partitioning walls 14*i* as desired.

A building made with structural system 10 has exceptional resistance to shear and uplift forces when the prefabricated sections are welded and those sections are then welded together at the job site, which is the preferred method. Shear is horizontal movement and uplift is vertical movement, resistance to which depends upon the connectors between the various building components. Wind or seismic events may induce both of these forces. Hence, structural system 10 provides greater earthquake and wind resistance than conventional wood or metal framing.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An improved structural system comprising a plurality of metal framed load bearing walls, each wall comprising one or more sections having an upper and a lower U-shaped track, each of which tracks has a longitudinal and a transverse axis, and a plurality of vertical C-shaped studs, each of which has a longitudinal and a transverse axis, arranged at predetermined intervals between said upper and lower tracks with the longitudinal axes of the tracks generally at right angles to the longitudinal axes of the studs and with the transverse axes of the tracks and studs generally parallel, a support post in line at the ends of each load bearing wall, said support posts comprising a pair of C-shaped studs having a web, said pair arranged back-to-back along the webs forming an I-beam with flanges on a plate adapted to be attached to a foundation or a slab, each load bearing wall attached to one of the flanges of the I-beam at the end of each load bearing wall, a plurality of metal framed roof trusses, each truss comprising one or more sections with a portion of an upper and a lower chord of the truss formed by U-shaped tracks, each of which tracks has a longitudinal and a transverse axis, and a plurality of vertical C-shaped studs, each of which has a longitudinal and a transverse axis, arranged at predetermined intervals between said upper and lower tracks with the longitudinal axes of the tracks generally at right angles to the longitudinal axes of the studs and with the transverse axes of the tracks and studs generally parallel, said lower track of each roof truss and the upper track of each wall section being connected back-to-back forming an I-beam and a roof frame, said roof frame comprising one or more sections having a right and left track and a plurality of vertical C-shaped studs arranged at predetermined intervals between said right and left tracks, said right and left tracks connected to the upper track of adjacent roof trusses.

2. The system of claim 1 wherein the C-shaped studs in each wall section and each truss section are welded in the upper and lower tracks and wherein the studs in each support post are welded back-to-back forming an I-beam.

3. The system of claim 2 wherein aligned flaps are formed in the upper and lower tracks and bent to allow connection to each stud.

4. The system of claim 3 wherein each flap is welded to the stud.

5. The system of claim 1 wherein one or more U-shaped channels are connected to the endmost stud at each end of each load bearing wall section, said U-shaped channels serving as shims for connection to the flange of the I-beam on each of the support posts.

6. The system of claim 5 wherein the U-shaped channels are welded to the endmost stud at each end of each wall section and to the flange of the I-beam on each of the support posts.

7. The system of claim 1 wherein a plurality of metal framed non-load bearing walls are connected to the support posts as curtain walls.

8. The system of claim 7 wherein the curtain walls are connected to the support posts with a plurality of straps on the flanges of the I-beam.

9. The system of claim 8 wherein the curtain walls are spaced apart on the straps to accommodate a downspout.

10. The system of claim 1 wherein the studs in each truss section and the studs in each wall section are in-line.

* * * * *